US009653779B2

(12) United States Patent
Wang et al.

(10) Patent No.: US 9,653,779 B2
(45) Date of Patent: May 16, 2017

(54) DUAL-BAND LTE MIMO ANTENNA

(75) Inventors: Dong Wang, Waterloo (CA); James Paul Warden, Ft. Worth, TX (US)

(73) Assignee: BlackBerry Limited, Waterloo, Ontario (CA)

( * ) Notice: Subject to any disclaimer, the term of this patent is extended or adjusted under 35 U.S.C. 154(b) by 631 days.

(21) Appl. No.: 13/551,913

(22) Filed: Jul. 18, 2012

(65) Prior Publication Data

US 2014/0023123 A1 Jan. 23, 2014

(51) Int. Cl.

| | |
|---|---|
| ***H01Q 1/24*** | (2006.01) |
| ***H01Q 1/38*** | (2006.01) |
| ***H01Q 9/04*** | (2006.01) |
| ***H01Q 9/42*** | (2006.01) |
| ***H01Q 21/28*** | (2006.01) |
| ***H01Q 21/30*** | (2006.01) |
| ***H01Q 5/371*** | (2015.01) |

(52) U.S. Cl.

CPC ..... *H01Q 1/243* (2013.01); *H01Q 1/38* (2013.01); *H01Q 5/371* (2015.01); *H01Q 9/0407* (2013.01); *H01Q 9/42* (2013.01); *H01Q 21/28* (2013.01); *H01Q 21/30* (2013.01)

(58) Field of Classification Search

CPC ..... H01Q 1/243; H01Q 5/371; H01Q 1/38; H01Q 9/0407; H01Q 9/42; H01Q 21/28; H01Q 21/30

USPC ..... 343/893, 844, 700 MS

See application file for complete search history.

(56) References Cited

U.S. PATENT DOCUMENTS

| | | | | |
|---|---|---|---|---|
| 6,515,627 B2 * | 2/2003 | Lopez | H01Q 1/243 343/700 MS | |
| 2005/0128162 A1 | 6/2005 | Takagi et al. | | |
| 2005/0195110 A1 | 9/2005 | Lin et al. | | |
| 2010/0194642 A1 * | 8/2010 | Rao et al. | 343/700 MS | |

(Continued)

FOREIGN PATENT DOCUMENTS

| | | |
|---|---|---|
| CN | 1627558 A | 6/2005 |
| CN | 1934748 A | 3/2007 |
| CN | 101114732 A | 1/2008 |

(Continued)

OTHER PUBLICATIONS

Extended European Search Report on European Application No. 13173970.8-1811, issued Dec. 12, 2013; 7 pages.

(Continued)

*Primary Examiner* — Graham Smith
*Assistant Examiner* — Jae Kim
(74) *Attorney, Agent, or Firm* — Conley Rose, P.C.; J. Robert Brown, Jr.

(57) ABSTRACT

A multiple-input-multiple output antenna for use with wireless communication comprises a first element a first radiation element operable to resonate at a first frequency and a second radiation element operable to resonate at a second frequency, wherein the second frequency is not an integer multiple of the first frequency. The first and second antenna radiation elements are each proximate to a ground plane and the respective resonance frequencies of the first radiation element and the second radiation element is achieved by controlling the electrical coupling between the first radiation element, the second radiation element and the ground plane and the resonance frequencies of the first and second radiation elements is controlled independently.

19 Claims, 5 Drawing Sheets

(56) References Cited

U.S. PATENT DOCUMENTS

| | | | | |
|---|---|---|---|---|
| 2011/0080333 | A1 | 4/2011 | Wu et al. | |
| 2014/0170992 | A1* | 6/2014 | Wang | H01Q 1/243 455/73 |

FOREIGN PATENT DOCUMENTS

| | | | | | |
|---|---|---|---|---|---|
| CN | 101730957 | A | | 6/2010 | |
| CN | 101938032 | A | | 1/2011 | |
| CN | 102110900 | A | | 6/2011 | |
| CN | 102124584 | A | | 7/2011 | |
| WO | WO 2013/012404 | | * | 7/2011 | H01Q 1/243 |
| WO | 2011105650 | | | 9/2011 | |

OTHER PUBLICATIONS

Canadian Office Action; Application No. 2,819,665; Feb. 12, 2015; 3 pages.

Chinese Office Action; Application No. 201310302304.9; Feb. 2, 2015; 14 pages.

Chinese Office Action as Received in Co-pending Application No. 201310302304.9 on Oct. 8, 2015; 6 pages. (No English translation available).

Chinese Office Action; Application No. 201310302304.9; Aug. 3, 2016; 12 pages.

Chinese Office Action as Received in Co-pending Application No. 201310302304.9 on Apr. 18, 2016; 10 pages. (No English translation available).

European Examination Report; Application No. 13173970.8; May 18, 2016; 7 pages.

Chinese Office Action as Received in Co-pending Application No. 201310302304.9 on Aug. 3, 2016; 9 pages. (No English translation available).

European Examination Report; Application No. 13173970.8; Feb. 23, 2017; 6 pages.

* cited by examiner

DUAL-BAND LTE MIMO ANTENNA

BACKGROUND OF THE DISCLOSURE

Field of the Disclosure

The present disclosure is directed in general to communication systems and, more specifically, to systems and methods for using multiple-input-multiple-output antennas in wireless communication systems.

Description of the Related Art

In the current Long Term Evolution (LTE) standard, a fourth generation (4G) standard related to the Third Generation Partnership Project (3GPP), developers must implement multiple-input, multiple-output (MIMO) antenna technology and a number of advanced signal processing techniques to achieve the maximum data rate. LTE promises significantly higher data rates for both upload and download, thereby enabling a wide variety of Internet Protocol (IP) services such as voice over internet protocol (VoIP) and online gaming. MIMO antenna designs in handset, personal digital assistant, and tablet is one of important technical solutions in 4G applications.

Current 4G handset applications for the LTE specification require dual band antennas operating at 700 MHz and 2600 MHz. Multi-band antennas can effectively reduce the number of antenna needed in mobile application.

Multi-band, multi-antenna technology in a handset is a very challenging as it requires multiple antennas that fit into compact phone space with multi-operating frequencies, high diversity and capacity performance. Therefore, an internal dual-antenna design capable of operating in dual-band and having a compact size is the first step of designing and developing the multi-band MIMO mobile communication system. However, when the multiple antennas are implemented in a compact handset, their performance deteriorates, which poses an important challenge for antenna designers to obtain the diversity and capacity performance needed while optimizing the antenna design and arrangement.

BRIEF DESCRIPTION OF THE DRAWINGS

The present invention may be understood, and its numerous objects, features and advantages obtained, when the following detailed description is considered in conjunction with the following drawings, in which.

DETAILED DESCRIPTION

Figure 1:
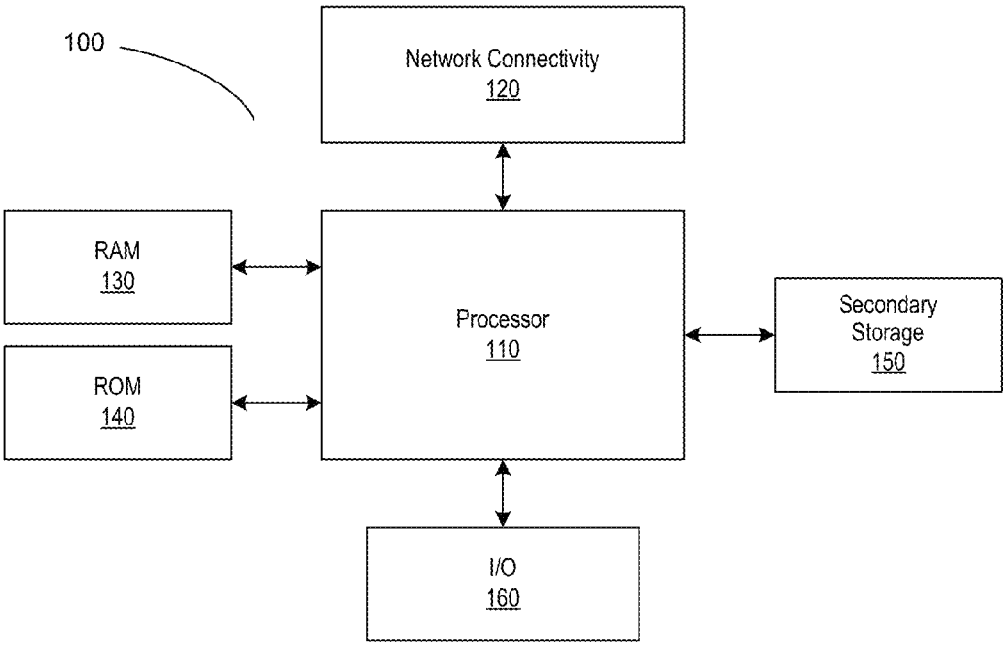
FIG. 1 depicts an exemplary system in which the present invention may be implemented.

Embodiments of the disclosure provide systems and methods for improving LTE user equipment performance implementing an improved multiple-input-multiple-output antenna. Various illustrative embodiments of the present invention will now be described in detail with reference to the accompanying figures. While various details are set forth in the following description, it will be appreciated that the present invention may be practiced without these specific details, and that numerous implementation-specific decisions may be made to the invention described herein to achieve the inventor's specific goals, such as compliance with process technology or design-related constraints, which will vary from one implementation to another. While such a development effort might be complex and time-consuming, it would nevertheless be a routine undertaking for those of skill in the art having the benefit of this disclosure. For example, selected aspects are shown in block diagram and flowchart form, rather than in detail, in order to avoid limiting or obscuring the present invention. In addition, some portions of the detailed descriptions provided herein are presented in terms of algorithms or operations on data within a computer memory. Such descriptions and representations are used by those skilled in the art to describe and convey the substance of their work to others skilled in the art.

As used herein, the terms "component," "system" and the like are intended to refer to a computer-related entity, either hardware, software, a combination of hardware and software, or software in execution on a machine, computer or processor. For example, a component may be, but is not limited to being, a processor, a process running on a processor, an object, an executable, a thread of execution, a program, or a computer. By way of illustration, both an application running on a computer and the computer itself can be a component. One or more components may reside within a process or thread of execution and a component may be localized on one computer or distributed between two or more computers.

As likewise used herein, the term "node" broadly refers to a connection point, such as a redistribution point or a communication endpoint, of a communication environment, such as a network. Accordingly, such nodes refer to an active electronic device capable of sending, receiving, or forwarding information over a communications channel. Examples of such nodes include data circuit-terminating equipment (DCE), such as a modem, hub, bridge or switch, and data terminal equipment (DTE), such as a handset, a printer or a host computer (e.g., a router, workstation or server). Examples of local area network (LAN) or wide area network (WAN) nodes include computers, packet switches, cable modems, Data Subscriber Line (DSL) modems, and wireless LAN (WLAN) access points. Examples of Internet or Intranet nodes include host computers identified by an Internet Protocol (IP) address, bridges and WLAN access points. Likewise, examples of nodes in cellular communication include base stations, relays, base station controllers, radio network controllers, home location registers, Gateway GPRS Support Nodes (GGSN), Serving GPRS Support Nodes (SGSN), Serving Gateways (S-GW), and Packet Data Network Gateways (PDN-GW).

Other examples of nodes include client nodes, server nodes, peer nodes and access nodes. As used herein, a client node may refer to wireless devices such as mobile telephones, smart phones, personal digital assistants (PDAs), handheld devices, portable computers, tablet computers, and similar devices or other user equipment (UE) that has telecommunications capabilities. Such client nodes may likewise refer to a mobile, wireless device, or conversely, to devices that have similar capabilities that are not generally transportable, such as desktop computers, set-top boxes, or sensors. Likewise, a server node, as used herein, refers to an information processing device (e.g., a host computer), or series of information processing devices, that perform information processing requests submitted by other nodes. As likewise used herein, a peer node may sometimes serve as client node, and at other times, a server node. In a peer-to-peer or overlay network, a node that actively routes data for other networked devices as well as itself may be referred to as a supernode.

An access node, as used herein, refers to a node that provides a client node access to a communication environment. Examples of access nodes include cellular network base stations and wireless broadband (e.g., WiFi, WiMAX, etc) access points, which provide corresponding cell and WLAN coverage areas. As used herein, a macrocell is used to generally describe a traditional cellular network cell coverage area. Such macrocells are typically found in rural areas, along highways, or in less populated areas. As likewise used herein, a microcell refers to a cellular network cell with a smaller coverage area than that of a macrocell. Such micro cells are typically used in a densely populated urban area. Likewise, as used herein, a picocell refers to a cellular network coverage area that is less than that of a microcell. An example of the coverage area of a picocell may be a large office, a shopping mall, or a train station. A femtocell, as used herein, currently refers to the smallest commonly accepted area of cellular network coverage. As an example, the coverage area of a femtocell is sufficient for homes or small offices.

In general, a coverage area of less than two kilometers typically corresponds to a microcell, 200 meters or less for a picocell, and on the order of 10 meters for a femtocell. As likewise used herein, a client node communicating with an access node associated with a macrocell is referred to as a "macrocell client." Likewise, a client node communicating with an access node associated with a microcell, picocell, or femtocell is respectively referred to as a "microcell client," "picocell client," or "femtocell client."

The term "article of manufacture" (or alternatively, "computer program product") as used herein is intended to encompass a computer program accessible from any computer-readable device or media. For example, computer readable media can include, but are not limited to, magnetic storage devices (e.g., hard disk, floppy disk, magnetic strips, etc.), optical disks such as a compact disk (CD) or digital versatile disk (DVD), smart cards, and flash memory devices (e.g., card, stick, etc.).

The word "exemplary" is used herein to mean serving as an example, instance, or illustration. Any aspect or design described herein as "exemplary" is not necessarily to be construed as preferred or advantageous over other aspects or designs. Those of skill in the art will recognize many modifications may be made to this configuration without departing from the scope, spirit or intent of the claimed subject matter. Furthermore, the disclosed subject matter may be implemented as a system, method, apparatus, or article of manufacture using standard programming and engineering techniques to produce software, firmware, hardware, or any combination thereof to control a computer or processor-based device to implement aspects detailed herein.

FIG. 1 illustrates an example of a system 100 suitable for implementing one or more embodiments disclosed herein. In various embodiments, the system 100 comprises a processor 110, which may be referred to as a central processor unit (CPU) or digital signal processor (DSP), network connectivity interfaces 120, random access memory (RAM) 130, read only memory (ROM) 140, secondary storage 150, and input/output (I/O) devices 160. In some embodiments, some of these components may not be present or may be combined in various combinations with one another or with other components not shown. These components may be located in a single physical entity or in more than one physical entity. Any actions described herein as being taken by the processor 110 might be taken by the processor 110 alone or by the processor 110 in conjunction with one or more components shown or not shown in FIG. 1.

The processor 110 executes instructions, codes, computer programs, or scripts that it might access from the network connectivity interfaces 120, RAM 130, or ROM 140. While only one processor 110 is shown, multiple processors may be present. Thus, while instructions may be discussed as being executed by a processor 110, the instructions may be executed simultaneously, serially, or otherwise by one or multiple processors 110 implemented as one or more CPU chips.

In various embodiments, the network connectivity interfaces 120 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, long term evolution (LTE) radio transceiver devices, worldwide interoperability for microwave access (WiMAX) devices, and/or other well-known interfaces for connecting to networks, including Personal Area Networks (PANs) such as Bluetooth. These network connectivity interfaces 120 may enable the processor 110 to communicate with the Internet or one or more telecommunications networks or other networks from which the processor 110 might receive information or to which the processor 110 might output information.

The network connectivity interfaces 120 may also be capable of transmitting or receiving data wirelessly in the form of electromagnetic waves, such as radio frequency signals or microwave frequency signals. Information transmitted or received by the network connectivity interfaces 120 may include data that has been processed by the processor 110 or instructions that are to be executed by processor 110. The data may be ordered according to different sequences as may be desirable for either processing or generating the data or transmitting or receiving the data.

In various embodiments, the RAM 130 may be used to store volatile data and instructions that are executed by the processor 110. The ROM 140 shown in FIG. 1 may likewise be used to store instructions and data that are read during execution of the instructions. The secondary storage 150 is typically comprised of one or more disk drives or tape drives and may be used for non-volatile storage of data or as an overflow data storage device if RAM 130 is not large enough to hold all working data. Secondary storage 150 may likewise be used to store programs that are loaded into RAM 130 when such programs are selected for execution. The I/O devices 160 may include liquid crystal displays (LCDs), Light Emitting Diode (LED) displays, Organic Light Emitting Diode (OLED) displays, projectors, televisions, touch screen displays, keyboards, keypads, switches, dials, mice, track balls, voice recognizers, card readers, paper tape readers, printers, video monitors, or other well-known input/output devices.

Figure 2:
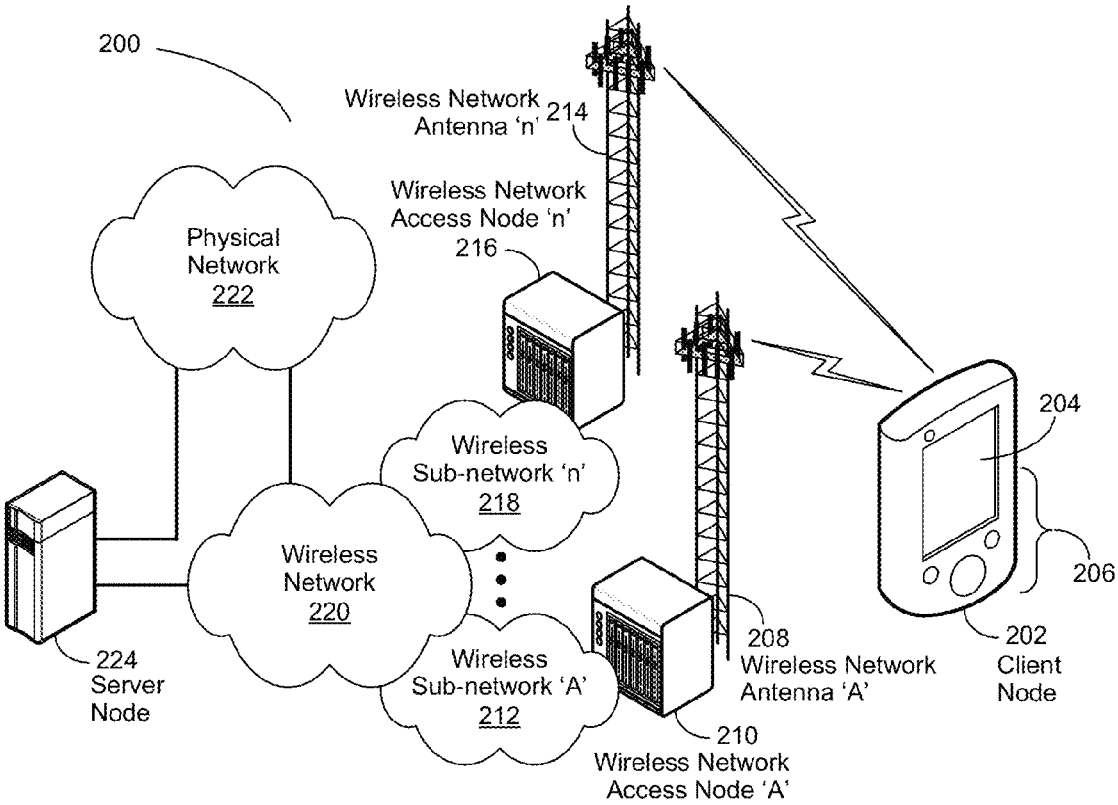
FIG. 2 shows a wireless-enabled communications environment including an embodiment of a client node.

FIG. 2 shows a wireless-enabled communications environment including an embodiment of a client node as implemented in an embodiment of the invention. Though illustrated as a mobile phone, the client node 202 may take various forms including a wireless handset, a pager, a smart phone, or a personal digital assistant (PDA). In various embodiments, the client node 202 may also comprise a portable computer, a tablet computer, a laptop computer, or any computing device operable to perform data communication operations. Many suitable devices combine some or all of these functions. In some embodiments, the client node 202 is not a general purpose computing device like a portable, laptop, or tablet computer, but rather is a special-purpose communications device such as a telecommunications device installed in a vehicle. The client node 202 may likewise be a device, include a device, or be included in a device that has similar capabilities but that is not transportable, such as a desktop computer, a set-top box, or a network node. In these and other embodiments, the client node 202 may support specialized activities such as gaming, inventory control, job control, task management functions, and so forth.

In various embodiments, the client node 202 includes a display 204. In these and other embodiments, the client node 202 may likewise include a touch-sensitive surface, a keyboard or other input keys 206 generally used for input by a user. The input keys 206 may likewise be a full or reduced alphanumeric keyboard such as QWERTY, Dvorak, AZERTY, and sequential keyboard types, or a traditional numeric keypad with alphabet letters associated with a telephone keypad. The input keys 206 may likewise include a trackwheel, an exit or escape key, a trackball, and other navigational or functional keys, which may be inwardly depressed to provide further input function. The client node 202 may likewise present options for the user to select, controls for the user to actuate, and cursors or other indicators for the user to direct.

The client node 202 may further accept data entry from the user, including numbers to dial or various parameter values for configuring the operation of the client node 202. The client node 202 may further execute one or more software or firmware applications in response to user commands. These applications may configure the client node 202 to perform various customized functions in response to user interaction. Additionally, the client node 202 may be programmed or configured over-the-air (OTA), for example from a wireless network access node 'A' 210 through 'n' 216 (e.g., a base station), a server node 224 (e.g., a host computer), or a peer client node 202.

Among the various applications executable by the client node 202 are a web browser, which enables the display 204 to display a web page. The web page may be obtained from a server node 224 through a wireless connection with a wireless network 220. As used herein, a wireless network 220 broadly refers to any network using at least one wireless connection between two of its nodes. The various applications may likewise be obtained from a peer client node 202 or other system over a connection to the wireless network 220 or any other wirelessly-enabled communication network or system.

In various embodiments, the wireless network 220 comprises a plurality of wireless sub-networks (e.g., cells with corresponding coverage areas) 'A' 212 through 'n' 218. As used herein, the wireless sub-networks 'A' 212 through 'n' 218 may variously comprise a mobile wireless access network or a fixed wireless access network. In these and other embodiments, the client node 202 transmits and receives communication signals, which are respectively communicated to and from the wireless network nodes 'A' 210 through 'n' 216 by wireless network antennas 'A' 208 through 'n' 214 (e.g., cell towers). In turn, the communication signals are used by the wireless network access nodes 'A' 210 through 'n' 216 to establish a wireless communication session with the client node 202. As used herein, the network access nodes 'A' 210 through 'n' 216 broadly refer to any access node of a wireless network. As shown in FIG. 2, the wireless network access nodes 'A' 210 through 'n' 216 are respectively coupled to wireless sub-networks 'A' 212 through 'n' 218, which are in turn connected to the wireless network 220.

In various embodiments, the wireless network 220 is coupled to a physical network 222, such as a global computer network or the Internet. Via the wireless network 220 and the physical network 222, the client node 202 has access to information on various hosts, such as the server node 224. In these and other embodiments, the server node 224 may provide content that may be shown on the display 204 or used by the client node processor 110 for its operations. Alternatively, the client node 202 may access the wireless network 220 through a peer client node 202 acting as an intermediary, in a relay type or hop type of connection. As another alternative, the client node 202 may be tethered and obtain its data from a linked device that is connected to the wireless network 212. Skilled practitioners of the art will recognize that many such embodiments are possible and the foregoing is not intended to limit the spirit, scope, or intention of the disclosure.

Figure 3:
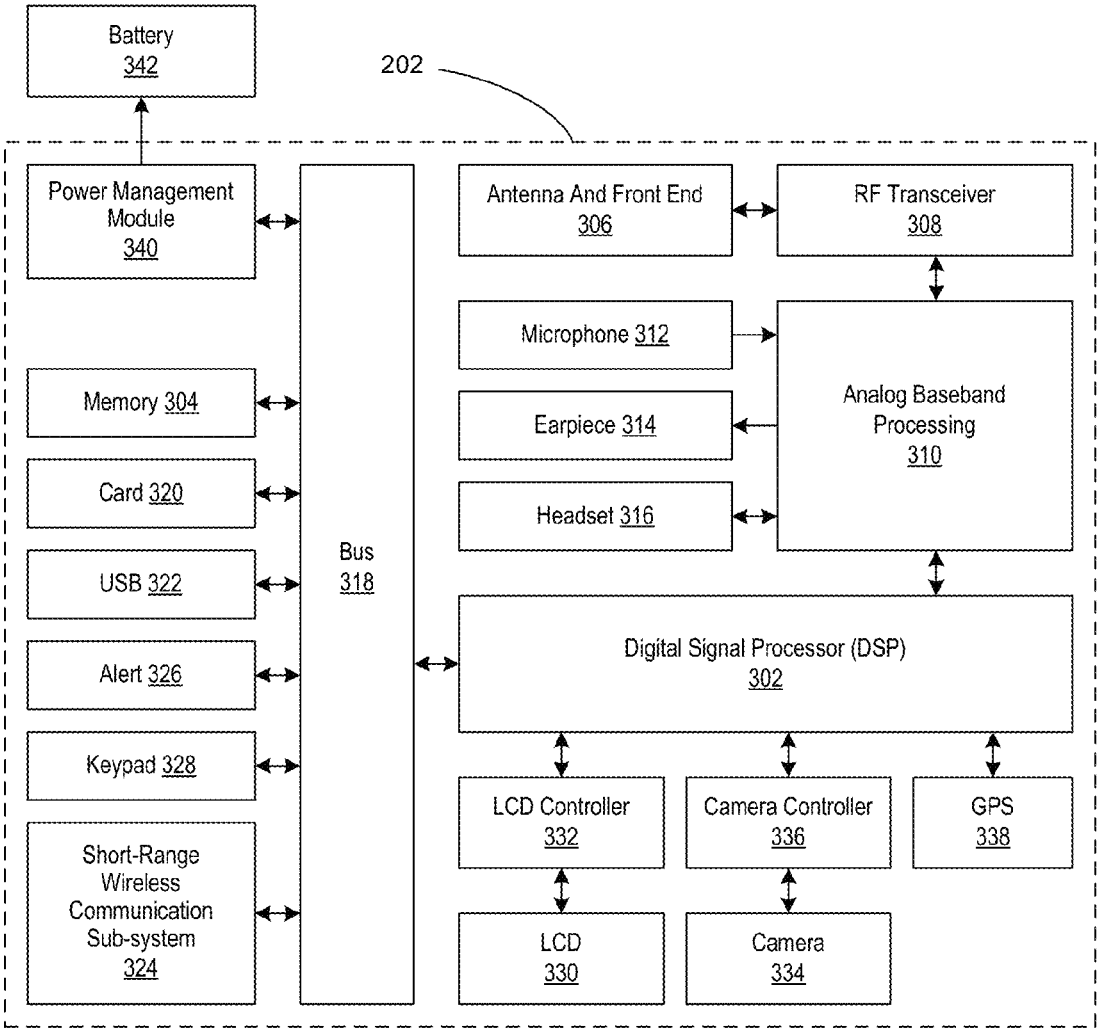
FIG. 3 is a simplified block diagram of an exemplary client node comprising a digital signal processor (DSP)

FIG. 3 depicts a block diagram of an exemplary client node as implemented with a digital signal processor (DSP) in accordance with an embodiment of the invention. While various components of a client node 202 are depicted, various embodiments of the client node 202 may include a subset of the listed components or additional components not listed. As shown in FIG. 3, the client node 202 includes a DSP 302 and a memory 304. As shown, the client node 202 may further include an antenna and front end unit 306, a radio frequency (RF) transceiver 308, an analog baseband processing unit 310, a microphone 312, an earpiece speaker 314, a headset port 316, a bus 318, such as a system bus or an input/output (I/O) interface bus, a removable memory card 320, a universal serial bus (USB) port 322, a short range wireless communication sub-system 324, an alert 326, a keypad 328, a liquid crystal display (LCD) 330, which may include a touch sensitive surface, an LCD controller 332, a charge-coupled device (CCD) camera 334, a camera controller 336, and a global positioning system (GPS) sensor 338, and a power management module 340 operably coupled to a power storage unit, such as a battery 342. In various embodiments, the client node 202 may include another kind of display that does not provide a touch sensitive screen. In one embodiment, the DSP 302 communicates directly with the memory 304 without passing through the input/output interface 318.

In various embodiments, the DSP 302 or some other form of controller or central processing unit (CPU) operates to control the various components of the client node 202 in accordance with embedded software or firmware stored in memory 304 or stored in memory contained within the DSP 302 itself. In addition to the embedded software or firmware, the DSP 302 may execute other applications stored in the memory 304 or made available via information carrier media such as portable data storage media like the removable memory card 320 or via wired or wireless network communications. The application software may comprise a compiled set of machine-readable instructions that configure the DSP 302 to provide the desired functionality, or the application software may be high-level software instructions to be processed by an interpreter or compiler to indirectly configure the DSP 302.

The antenna and front end unit 306 may be provided to convert between wireless signals and electrical signals, enabling the client node 202 to send and receive information from a cellular network or some other available wireless communications network or from a peer client node 202. In an embodiment, the antenna and front end unit 106 may include multiple antennas to support beam forming and/or multiple input multiple output (MIMO) operations. MIMO operations may provide spatial diversity which can be used to overcome difficult channel conditions or to increase channel throughput. Likewise, the antenna and front end unit 306 may include antenna tuning or impedance matching components, RF power amplifiers, or low noise amplifiers. In various examples, the structures in the antenna and front end unit 306 can include the antenna structures shown in any of FIGS. 5-7 and include the related description herein.

In various embodiments, the RF transceiver 308 provides frequency shifting, converting received RF signals to baseband and converting baseband transmit signals to RF. In some descriptions a radio transceiver or RF transceiver may be understood to include other signal processing functionality such as modulation/demodulation, coding/decoding, interleaving/deinterleaving, spreading/despreading, inverse fast Fourier transforming (IFFT)/fast Fourier transforming (FFT), cyclic prefix appending/removal, and other signal processing functions. For the purposes of clarity, the description here separates the description of this signal processing from the RF and/or radio stage and conceptually allocates that signal processing to the analog baseband processing unit 310 or the DSP 302 or other central processing unit. In some embodiments, the RF Transceiver 108, portions of the Antenna and Front End 306, and the analog base band processing unit 310 may be combined in one or more processing units and/or application specific integrated circuits (ASICs).

The analog baseband processing unit 310 may provide various analog processing of inputs and outputs, for example analog processing of inputs from the microphone 312 and the headset 316 and outputs to the earpiece 314 and the headset 316. To that end, the analog baseband processing unit 310 may have ports for connecting to the built-in microphone 312 and the earpiece speaker 314 that enable the client node 202 to be used as a cell phone. The analog baseband processing unit 310 may further include a port for connecting to a headset or other hands-free microphone and speaker configuration. The analog baseband processing unit 310 may provide digital-to-analog conversion in one signal direction and analog-to-digital conversion in the opposing signal direction. In various embodiments, at least some of the functionality of the analog baseband processing unit 310 may be provided by digital processing components, for example by the DSP 302 or by other central processing units.

The DSP 302 may perform modulation/demodulation, coding/decoding, interleaving/deinterleaving, spreading/despreading, inverse fast Fourier transforming (IFFT)/fast Fourier transforming (FFT), cyclic prefix appending/removal, and other signal processing functions associated with wireless communications. In an embodiment, for example in a code division multiple access (CDMA) technology application, for a transmitter function the DSP 302 may perform modulation, coding, interleaving, and spreading, and for a receiver function the DSP 302 may perform despreading, deinterleaving, decoding, and demodulation. In another embodiment, for example in an orthogonal frequency division multiplex access (OFDMA) technology application, for the transmitter function the DSP 302 may perform modulation, coding, interleaving, inverse fast Fourier transforming, and cyclic prefix appending, and for a receiver function the DSP 302 may perform cyclic prefix removal, fast Fourier transforming, deinterleaving, decoding, and demodulation. In other wireless technology applications, yet other signal processing functions and combinations of signal processing functions may be performed by the DSP 302.

The DSP 302 may communicate with a wireless network via the analog baseband processing unit 310. In some embodiments, the communication may provide Internet connectivity, enabling a user to gain access to content on the Internet and to send and receive e-mail or text messages. The input/output interface 318 interconnects the DSP 302 and various memories and interfaces. The memory 304 and the removable memory card 320 may provide software and data to configure the operation of the DSP 302. Among the interfaces may be the USB interface 322 and the short range wireless communication sub-system 324. The USB interface 322 may be used to charge the client node 202 and may also enable the client node 202 to function as a peripheral device to exchange information with a personal computer or other computer system. The short range wireless communication sub-system 324 may include an infrared port, a Bluetooth interface, an IEEE 802.11 compliant wireless interface, or any other short range wireless communication sub-system, which may enable the client node 202 to communicate wirelessly with other nearby client nodes and access nodes.

The input/output interface 318 may further connect the DSP 302 to the alert 326 that, when triggered, causes the client node 202 to provide a notice to the user, for example, by ringing, playing a melody, or vibrating. The alert 326 may serve as a mechanism for alerting the user to any of various events such as an incoming call, a new text message, and an appointment reminder by silently vibrating, or by playing a specific pre-assigned melody for a particular caller.

The keypad 328 couples to the DSP 302 via the I/O interface 318 to provide one mechanism for the user to make selections, enter information, and otherwise provide input to the client node 202. The keyboard 328 may be a full or reduced alphanumeric keyboard such as QWERTY, Dvorak, AZERTY and sequential types, or a traditional numeric keypad with alphabet letters associated with a telephone keypad. The input keys may likewise include a trackwheel, an exit or escape key, a trackball, and other navigational or functional keys, which may be inwardly depressed to provide further input function. Another input mechanism may be the LCD 330, which may include touch screen capability and also display text and/or graphics to the user. The LCD controller 332 couples the DSP 302 to the LCD 330.

The CCD camera 334, if equipped, enables the client node 202 to take digital pictures. The DSP 302 communicates with the CCD camera 334 via the camera controller 336. In another embodiment, a camera operating according to a technology other than Charge Coupled Device cameras may be employed. The GPS sensor 338 is coupled to the DSP 302 to decode global positioning system signals or other navigational signals, thereby enabling the client node 202 to determine its position. Various other peripherals may also be included to provide additional functions, such as radio and television reception.

Figure 4:
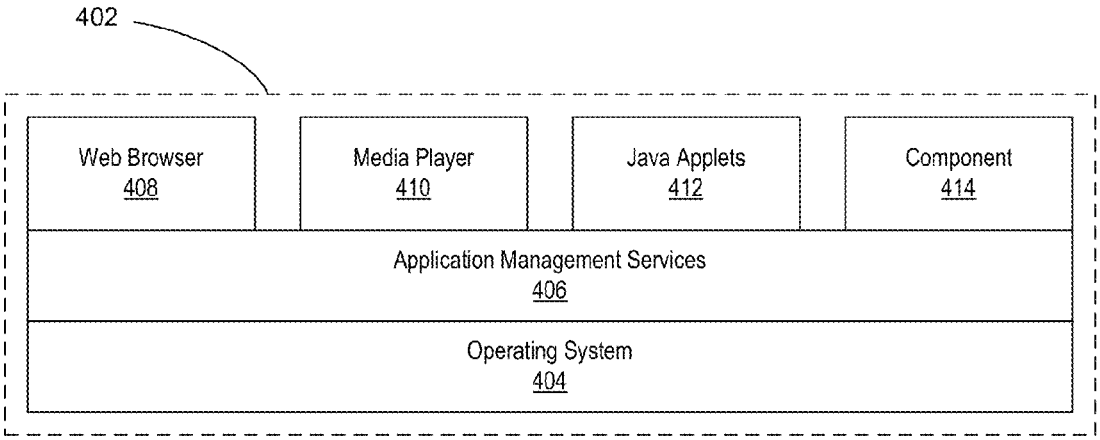
FIG. 4 is a simplified block diagram of a software environment that may be implemented by a DSP.

FIG. 4 illustrates a software environment 402 that may be implemented by a digital signal processor (DSP). In this embodiment, the DSP 302 shown in FIG. 3 executes an operating system 404, which provides a platform from which the rest of the software operates. The operating system 404 likewise provides the client node 202 hardware with standardized interfaces (e.g., drivers) that are accessible to application software. The operating system 404 likewise comprises application management services (AMS) 406 that transfer control between applications running on the client node 202. Also shown in FIG. 4 are a web browser application 408, a media player application 410, and Java applets 412. The web browser application 408 configures the client node 202 to operate as a web browser, allowing a user to enter information into forms and select links to retrieve and view web pages. The media player application 410 configures the client node 202 to retrieve and play audio or audiovisual media. The Java applets 412 configure the client node 202 to provide games, utilities, and other functionality. A component 414 may provide functionality described herein. In various embodiments, the client node 202, the wireless network nodes 'A' 210 through 'n' 216, and the server node 224 shown in FIG. 2 may likewise include a processing component that is capable of executing instructions related to the actions described above.

Figure 5:
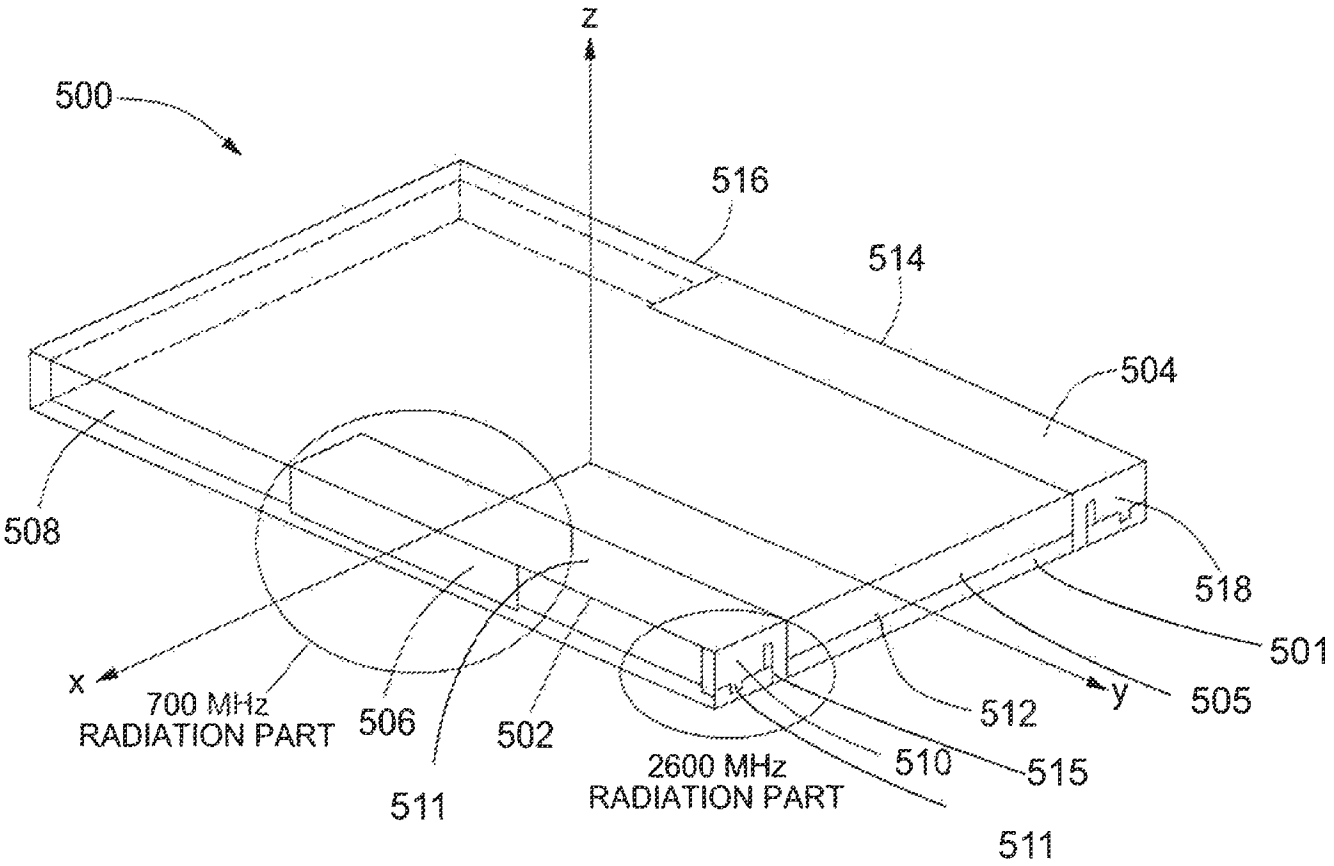
FIG. 5 is an illustration of a user equipment comprising first and second multi-frequency antennas in accordance with embodiments of the disclosure.

FIG. 5 is a phantom view illustration of a user equipment 500 having a ground plane 501, first and second antennas 502 and 504, in accordance with embodiments of the disclosure, disposed on a dielectric antenna supporter 505 that is mounted inside the case of the user equipment. The phantom view shows the user equipment with the outer case removed as the antenna structures are internal to the user equipment, e.g., inside the cover or case and beneath the display. Moreover, the circuitry (e.g., antenna front end circuitry and other circuitry) that electrically communicates with the antennas is not shown for clarity purposes. The dielectric antenna supporter 505 can be fixed to other internal components of the user equipment and/or to the outer case. In an example, the antenna supporter 505 includes a cuboid or generally rectangular parallelepiped structure, which can be made of a glass epoxy, such as FR4.

Figure 6:
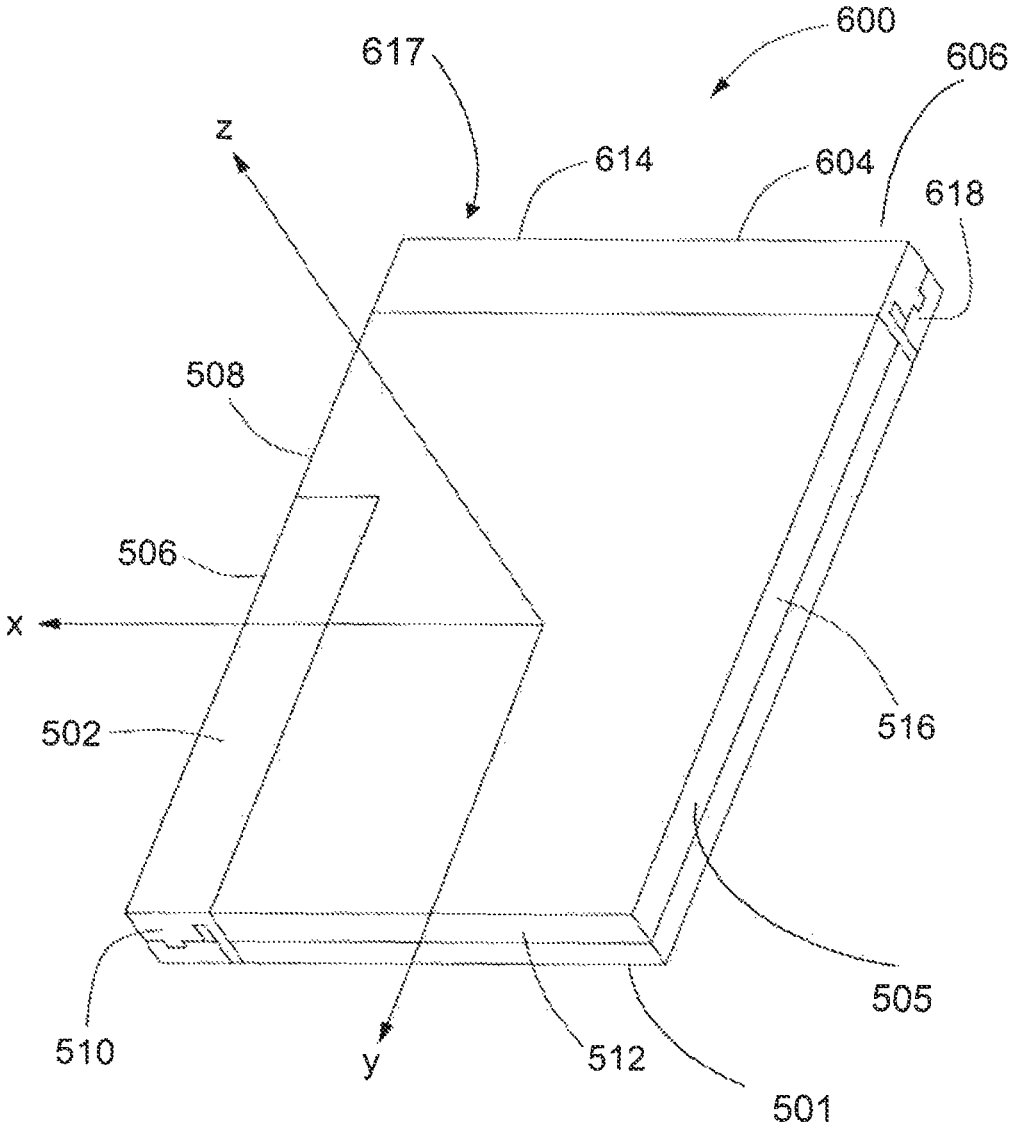
FIG. 6 is an illustration of a user equipment comprising first and second multi-frequency antennas in accordance with alternate embodiments of the disclosure.
Figure 7:
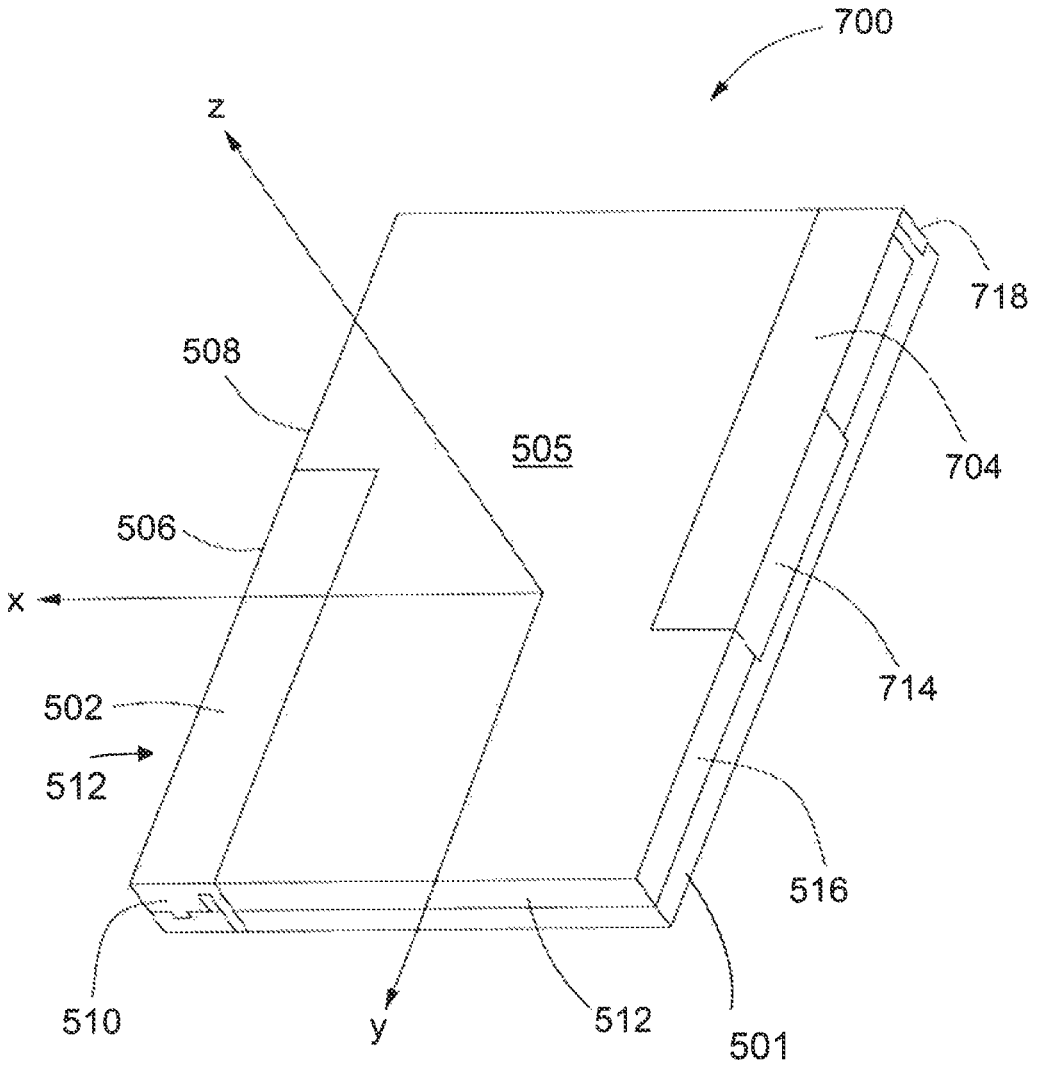
FIG. 7 is an illustration of a user equipment comprising first and second multi-frequency antennas in accordance with other alternate embodiments of the disclosure.

For purposes of clarity, some of the following discussion will refer to certain antenna components by referring to the three orthogonal axes, X, Y, and Z, shown in FIGS. 5-7. Antenna 502 comprises a first, 700 MHz radiating element 506 that is disposed on a surface 508 of the antenna supporter 505 that is substantially parallel to the Y axis and a second, 2600 MHz radiating element 510 that is disposed on the surface 508 In this example, the first radiating element 506 is substantially co-planar with the second radiating element 510. The first radiating element 506 is connected to the second radiating element 510 through a conductive body 511 on a top surface (in an X-Y plane) of the antenna supporter 505. A feedpoint 513 is positioned in a surface 512 of the antenna supporter 505. Surface 512 is orthogonal to surface 508. A shorting element 515 is adjacent the feedpoint on the surface 512 and extends from the conductive body 511 to the ground plane 501. Antenna 504 is essentially a "mirror image" of antenna 502, e.g., generally about the Y axis and on another side of the antenna supporter 505. In the illustrated example, antennas 502 and 504 are not mirror images about the X axis. Antenna 504 includes a first, 700 MHz radiating element (not shown in FIG. 5) that is disposed on surface 516 that is substantially parallel to the Y axis and a second, 2600 MHz radiating element that is disposed on surface 516. The feedpoints and shorting elements of both the first antenna 502 and second antenna 504 are positioned and supported on a same surface 512 of the antenna supporter 505. The first radiating elements 506 and 514 and second radiating 510 and 518 (not shown) are on opposite sides of the antenna supporter 505.

While the antennas 502 and 504 are described as radiating at 700 MHZ and 2600 MHz respectively, it will be understood that that these are two example frequencies, which can be other frequencies as well as long as the frequencies are not integer multiples of each other. In some embodiments, the antennas are not harmonics of each other or do not share the same fundamental frequency.

FIG. 6 is a phantom view illustration of a user equipment 600 having first and second antennas 502 and 604, respectively, in accordance with alternate embodiments of the disclosure, disposed on the antenna supporter 505 and, when fully assembled inside the case of the user equipment. Antenna 502 is in the same relative position as antenna 502 in FIG. 5 and includes the same elements. Antenna 604 includes elements that are substantially the same as antenna 504 of FIG. 5 but are at a different location on the antenna supporter 505. Antenna 604 is translated to another side surface 617 of the antenna supporter 505. Accordingly, the first radiating elements 506, 614 extend transverse to each other and, in the illustrated example, extend in different orthogonal planes relative to each other. Likewise, the translation of the second radiating elements 510, 518 extend transverse to each other and, in the illustrated example, extend in different orthogonal planes. A first, 700 MHz radiating element 614 is disposed on the surface 617 that is substantially transverse to the surface 512. A second, 2600 MHz radiating element 606 is disposed on surface 617 and has the same orientation in antenna 604 as element 518 has within antenna 504 but in a different position on the antenna supporter 505. The first radiating element 614 extends the width of the antenna supporter 505 (in the X direction of FIG. 6).

FIG. 7 is a phantom view illustration of a user equipment 700 having first and second antennas 502 and 704, respectively, in accordance with another alternate embodiment of the disclosure, disposed on antenna supporter 505. Antenna 502 is in the same relative position as antenna 502 in FIG. 5 and includes the same elements. Antenna 704 includes elements that are substantially the same as antenna 504 of FIG. 5, but are at a different location on the antenna supporter 505 shown in FIG. 7. A first, 700 MHz radiating element 714 is disposed on surface 516 that is substantially parallel to, and on the opposite side of, the user equipment 700 with respect to surface 512. A second, 2600 MHz radiating element 718 is disposed on surface 516 and has the same orientation in antenna 714 as element 518 has within antenna 504 with reference to radiating element 506 but is positioned at another end of the surface 516.

With reference to FIGS. 6 and 7, the antennas 502 and 604, 704 are described as radiating at 700 MHZ and 2600 MHz, respectively, it will be understood that that these are two example frequencies, which can be other frequencies as well as long as the frequencies are not integer multiples of each other. In some embodiments, the antennas are not harmonics of each other or do not share the same fundamental frequency.

In the various embodiments illustrated in FIGS. 5-7, resonance tuning at the low band is achieved through electrical coupling of the vertical portion of the antenna structure aligned with the longitudinal side of the ground plane Tuning of the high band is accomplished by controlling of the electrical coupling of the antenna structure through the vertical portion adjacent to its feed point and the shorter edge of the ground plane. The size, location, and separation distance of these portions on the antenna defines the resonance frequency and the radiation characteristics at these frequencies.

In the various embodiments described herein, controlling resonance at the low band is independent of controlling resonance in the high band. Therefore, the embodiments described herein can be easily applied to fine tune at one frequency while preserving the response at the second frequency.

Being able to independently fine tune each frequency provides a tool to control the antenna radiation characteristics at each frequency making it an attractive candidate for multi-antenna technology with very good performance.

Embodiments of the disclosure integrate dual bands—700 MHz and 2600 MHz—and dual antennas in a single mobile device. Prior art LTE MIMO antennas only operated in one band, 700 MHz or 2.6 GHz. Therefore, the embodiments described herein reduce the number of antennas needed and thereby minimize the antenna space requirements in mobile devices. The antenna embodiments described herein provide large frequency spans. The frequency span can be as large as 1.9 GHz (0.7-2.6 GHz). As will be understood by those of skill in the art, the second resonance of 2.6 GHz is not a multiple of the first resonance at 700 MHz In the embodiments described herein, the coupling between the two antennas is less than 10 dB at 700 MHz band, less than 15 dB at 2.6 GHz band. This has the effect of reducing the coupling loss and increasing the antenna radiation efficiency.

In the various embodiments described herein, the capacity for the 2×2 MIMO system performance is improved: >25% at 700 MHz and >50% at 2.6 GHzCompared to a 1×2 system.

This embodiments disclosed herein present a lower envelope correlation coefficient (ECC<0.3). Thus it achieves the requirement of <0.5.

The various embodiments also achieve a higher radiation efficiency: >50% at 700 MHz band and 2.6 GHz bands, higher diversity gain (>10 dB) and higher MEG (mean effective gain) >−5 dB.

Embodiments of the dual-band antennas disclosed herein are compact in design. For example, a dual-band antenna for a handset, using embodiments of the disclosure can be implemented with an antenna that is 10 mm wide×7 mm thick×58 mm long that will easily fit into 55 mm×95 mm current handset devices. A dual-band antenna for a tablet computer, based on the example embodiments herein, can be implemented with an antenna that is 58 mm×10 mm×9 mm mounted on a 120 mm×185 mm ground plane.

Although the described exemplary embodiments disclosed herein are described with reference to estimating the impedance of antennas in wireless devices, the present disclosure is not necessarily limited to the example embodiments which illustrate inventive aspects of the present invention that are applicable to a wide variety of authentication algorithms. Thus, the particular embodiments disclosed above are illustrative only and should not be taken as limitations upon the present invention, as the invention may be modified and practiced in different but equivalent manners apparent to those skilled in the art having the benefit of the teachings herein. Accordingly, the foregoing description is not intended to limit the invention to the particular form set forth, but on the contrary, is intended to cover such alternatives, modifications and equivalents as may be included within the spirit and scope of the invention as defined by the appended claims so that those skilled in the art should understand that they can make various changes, substitutions and alterations without departing from the spirit and scope of the invention in its broadest form.

What is claimed is:

1. A wireless communication device that uses at least at two frequencies, comprising:

a support having:

a first planar surface in a first plane and a second planar surface in a second plane between which extend a plurality of planar side surfaces, each in a respective plane, the second planar surface spaced from the first planar surface;

a first corner formed by an abutment of the first planar surface and a first pair of the plurality of side surfaces; and a second corner formed by an abutment of the first planar surface and a second pair of side surfaces, where at least one of the side surfaces of the second pair is different to the first pair;

a first antenna disposed at the first corner of the support and configured to have:

a first single feed point, being a singular feed point of the first antenna, the first single feed point formed on a first side surface of the first pair of side surfaces;

a first rectangular planar radiation element disposed on a second side surface of the first pair of side surfaces in a plane substantially orthogonal to a plane of the first side surface on which the first single feed point is formed, the first rectangular planar radiation element spaced from said first corner and configured to resonate at a first frequency when excited at the first single feed point;

a second rectangular radiation element configured to form a corner at the first corner, a first rectangular portion of the second rectangular radiation element spaced from, and coplanar with the first rectangular planar radiation element, a remaining second rectangular portion substantially orthogonal to said first rectangular portion and substantially coplanar with the plane of the first feed point, the second rectangular radiation element configured to resonate at a second frequency which is a non-harmonic of the first frequency and being connected to the first rectangular planar radiation element through a first planar conductive body formed on the first planar surface of the support, wherein said second frequency is not an integer multiple of said first frequency, the first planar conductive body formed in a plane orthogonal to the respective planes of the first and the second rectangular radiation elements and the first single feed point;

a first shorting element adjacent the first feed point and extending from the first planar conductive body; and a second antenna disposed at the second corner of the support and configured to have:

a second single feed point, being a singular feed point of the second antenna, the first single feed point formed on a first side surface of the second pair of side surfaces;

a third rectangular planar radiation element formed on a second side surface of the second pair of the side surfaces of the support in a plane substantially orthogonal to the second feed point and configured to resonate at the first frequency, the third rectangular planar radiation element spaced from said second corner; and a fourth rectangular radiation element configured to form a corner at the second corner of the support, a third rectangular portion of the fourth rectangular radiation element spaced from, and coplanar with the third rectangular planar radiation element, a remaining fourth rectangular portion substantially orthogonal to said third rectangular portion and substantially coplanar with the plane of the second feed point, the fourth radiation element configured to resonate at the second frequency and connected to the third radiation element through a second planar conductive body formed on the first planar surface of the support, the second planar conductive body formed in a plane orthogonal to the respective planes of the third and the fourth rectangular radiation elements and the second single feed point; and a second shorting element adjacent the second feed point and extending from the second planar conductive body.

2. The wireless communication device of claim 1, wherein said first antenna is configured to transmit and receive communication signals simultaneously on both said first frequency and said second frequency.

3. The wireless communication device of claim 1, wherein said first radiation element is proximate to a ground plane and the first frequency of said first radiation element is configured by a first electrical coupling between said first element and said ground plane.

4. The wireless communication device of claim 3, wherein said second radiation element is proximate to a ground plane and the second frequency of said second radiation element is configured by a second electrical coupling between said second radiation element and said ground plane.

5. The wireless communication device of claim 1, wherein the first and second frequencies of said first and second radiation elements are configured independently.

6. The wireless communication device of claim 5, wherein the first resonance frequency is 700 MHz and the second resonance frequency is 2600 MHz.

7. A wireless device, comprising:

a support having:

a first planar surface in a first plane and a second planar surface in a second plane between which extend a plurality of planar side surfaces, each in a respective plane, the second planar surface spaced from the first planar surface;

a first corner formed by an abutment of the first planar surface and a first pair of the plurality of side surfaces; and a second corner formed by an abutment of the first planar surface and a second pair of side surfaces, where at least one of the side surfaces of the second pair is different to the first pair;

first and second dual-band antennas formed on said support at respectively different ones of the first and second corners of the support, each of said first and second dual band antennas comprising:

a single feed point, being a singular feed point of the antenna, the first single feed point formed on one of the side surfaces;

a first rectangular planar radiation element formed on a respectively different side surface than the one of the side surfaces of the support and being in a plane substantially orthogonal to a plane of the single feed point and configured to transmit and receive communication signals at a first frequency; and a second rectangular radiation element configured to form a corner at one of the respective first and second corners of the support, a first rectangular portion of the second rectangular radiation element spaced from, and coplanar with the first rectangular planar radiation element, a remaining second rectangular portion substantially orthogonal to said first rectangular portion and substantially coplanar with the plane of the first feed point, the second planar radiation element being configured to transmit and receive communication signals at a second frequency, wherein said second frequency is not an integer multiple of said first frequency and the second planar radiation element connected to the first planar radiation element through a conductive body disposed on said surface of the antenna supporter, the planar conductive body formed in a plane orthogonal to the respective planes of the first and the second planar radiation elements and the single feed point;

a shorting element adjacent the feed point and extending from the planar conductive body and processing logic configured to control said first and second dual band antennas to transmit and receive communication signals at said first frequency and said second frequency.

8. The wireless device of claim 7, wherein said first and second dual-band antennas are each configured to transmit and receive communication signals simultaneously on both said first frequency and said second frequency.

9. The wireless device of claim 7, wherein said first antenna radiation element is proximate to a ground plane and the resonance frequency of said first radiation element is configured by a first electrical coupling between said first radiation element and said ground plane.

10. The wireless device of claim 9, wherein said first antenna radiation element is proximate to the ground plane and the resonance frequency of said second radiation element is configured by a second electrical coupling between said second radiation element and said ground plane.

11. The wireless device of claim 7, wherein the resonance frequencies of said first and second radiation elements are configured independently.

12. The wireless device of claim 11, wherein the first resonance frequency is 700 MHz and the second resonance frequency is 2600 MHz.

13. A method for transmitting signals on a wireless user equipment device, the method comprising:

using a first antenna that resonates at least at two frequencies to transmit and receive communication signals at first and second frequencies, wherein said antenna comprises:

a support having:

a first planar surface in a first plane and a second planar surface in a second plane between which extend a plurality of planar side surfaces each in a respective plane, the second planar surface spaced from the first planar surface;

a first corner formed by an abutment of the first planar surface and a first pair of the plurality of side surfaces; and a second corner formed by an abutment of the first planar surface and a second pair of side surfaces, where at lease one of the side surfaces of the second pair is different to the first pair;

the first antenna disposed at the first corner of the support and configured to have:

a first single feed point being a singular feed point of the first antenna, the first single feed point formed on a first side surface of the first pair of side surfaces;

a first rectangular planar radiation element formed on a second side surface of the first pair of side surfaces in a plane substantially orthogonal to a plane of the first side surface on which the first single feed pint is formed and configured to resonate at said first frequency, the first rectangular planar radiation element spaced from said first corner; and a second rectangular radiation element configured to form a corner at the first corner, a first rectangular portion of the second rectangular radiation element spaced from, and coplanar with the first rectangular planar radiation element, a remaining second rectangular portion substantially orthogonal to said first rectangular portion and substantially coplanar with the plane of the first feed point, the second rectangular radiation element configured to resonate at said second frequency, wherein said second frequency is not an integer multiple of said first frequency and the second rectangular radiation element being connected to the first rectangular planar radiation element through a first planar conductive body formed on the first planar surface of the support, the first planar conductive body formed in a plane orthogonal to the respective planes of the first and the second rectangular radiation elements and the first single feed point;

a first shorting element adjacent the first feed point and extending from the first planar conductive body;

using a second antenna that resonates at the at least two frequencies to transmit and receive communication signals at the first and second frequencies, the second antenna being disposed at the second corner of the support wherein said second antenna comprises:

a second single feed point being a singular feed point of the antenna, the first single feed point formed on a first side surface of the second pair of side surfaces;

a third rectangular planar radiation element formed on a second side surface of the second pair side surfaces of the support in a plane substantially orthogonal to the second feed point and configured to resonate at the first frequency, the third rectangular planar radiation element spaced from said second corner; and a fourth rectangular radiation element configured to form a corner at the second corner of the support, a third rectangular portion of the fourth rectangular radiation element spaced from, and coplanar with the third rectangular planar radiation element, a remaining fourth rectangular portion substantially orthogonal to said third rectangular portion and substantially coplanar with the plane of the second feed point, the fourth rectangular planar radiation element configured to resonate at the second frequency and connected to the third rectangular planar radiation element through a second planar conductive body disposed on said first planar surface of the antenna supporter the second planar conductive body formed in a plane orthogonal to the respective planes of the third and the fourth radiation element and the second feed point; and a second shorting element adjacent the second feed point and extending from the second planar conductive body.

14. The method of claim 13, wherein said first antenna is configured to transmit and receive communication signals simultaneously on both said first frequency and said second frequency.

15. The method of claim 13, wherein said first antenna radiation element is proximate to a ground plane and the resonance frequency of said first radiation element is configured by a first electrical coupling between said first radiation element and said ground plane.

16. The method of claim 13, wherein said first antenna radiation element is proximate to a ground plane and the resonance frequency of said second radiation element is configured by a second electrical coupling between said second radiation element and said ground plane.

17. The method of claim 13, wherein the resonance frequencies of said first and second radiation elements are configured independently.

18. The method of claim 13, wherein the first resonance frequency is 700 MHz and the second frequency is 2600 MHz.

19. The wireless communication device of claim 1, wherein the first and second frequencies do not share a same fundamental frequency.

* * * * *